US005750479A

United States Patent [19]

Kramer

[11] Patent Number: 5,750,479

[45] Date of Patent: May 12, 1998

[54] ENCLOSED FLUID SYSTEM CONDITIONER AND PROCESS THEREFOR

[75] Inventor: Ronald A. Kramer, Dublin, Ohio

[73] Assignee: Bandon Corp., Dublin, Ohio

[21] Appl. No.: 800,851

[22] Filed: Feb. 14, 1997

[51] Int. Cl.[6] ..... C10M 129/70

[52] U.S. Cl. ..... 508/463; 252/68

[58] Field of Search ..... 508/463, 465; 252/68

[56] References Cited

U.S. PATENT DOCUMENTS 2,113,752 4/1938 Wiezevich ..... 508/463

2,351,280 6/1944 Morgan ..... 508/463

2,757,139 7/1956 Matuszak et al. ..... 508/463

*Primary Examiner*—Jacqueline V. Howard

*Attorney, Agent, or Firm*—Hudak & Shunk Co., L.P.A.

[57] ABSTRACT

Internal seals including gaskets and the like of a hydraulic and other enclosed fluid systems can be conditioned with an ester composition desirably an acetate ester. The composition can be combined with a system's fluid, or used itself as a system fluid alone or in combination with other additives. Conditioning includes softening said internal seals and gaskets so they are more effective at sealing.

20 Claims, No Drawings

ENCLOSED FLUID SYSTEM CONDITIONER AND PROCESS THEREFOR

FIELD OF THE INVENTION

The present invention relates to improved enclosed fluid system additives, including hydraulic system fluids such as automotive transmission and power steering fluids, that improve the condition of seals such as gaskets, rings, and the like.

BACKGROUND OF THE INVENTION

Many enclosed fluid system such as hydraulic system utilize seals such as gaskets, rings, cups, packings, wipers, bushings, washers, and the like both internally and as part of the casing, which come in contact with the system's internal fluids. These seals, etc. are typically made of polymeric materials. The polymeric material may be a natural polymer such as natural rubber or cellulose or a synthetic polymer such as nitrile rubber. Over time they may harden or shrink, thereby allowing the internal fluids to bypass them, leak, or otherwise act in an undesirable manner. A number of prior art chemicals have been incorporated in automotive transmission and other hydraulic fluids, or offered as separate additive products, in order to lessen seal hardening or shrinking, or to soften or swell already hardened or swollen seals. Various solvents and plasticizers have been used as additives for these purposes, including aromatic solvents like toluene and plasticizers such as phosphate esters, phthalate esters, and benzoic esters.

SUMMARY OF THE INVENTION

The invention in general relates to a process of treating enclosed fluid systems, including hydraulic systems like automotive transmissions, hydrostatic transmissions and power steering systems, as well as other enclosed fluid systems such as enclosed lubricated gears where a contained fluid is maintained in contact with the internal parts of the system for lubrication, cooling, or other functional purpose. More specifically, the invention relates to the treatment and conditioning of an enclosed fluid system's seals, preferably polymeric seals, such as gaskets, rings, cups, packings, wipers, bushings, washers and the like with a liquid composition which comprises of one or more esters such as acetate esters. The seals may be internal to the system or sealing the system to another component such as a casing or motor.

Refrigeration and air conditioning systems that combine fluid lubricants with the refrigerant are also within the scope of the enclosed fluid systems described herein.

The conditioner composition is added to the system's fluid, or optionally is used as the system's fluid if the conditioner composition's other characteristics are compatible with the system's requirements. The conditioner composition thus needs to be both compatible with the seal material and miscible with any other fluids. The composition is used along with or in combination with the system's other additives such as plasticizers, diluents, lubricants, long chain polymers, viscosity index improvers, solvents, penetrating agents, pour point depressants, antioxidants, stabilizers, friction modifiers, antiwear additives (extreme pressure additives), metal protectants, hydraulic automotive transmission or power steering fluids, or combinations of the foregoing.

The invention also relates to a composition of matter consisting of an acetate ester combined with one or more plasticizers, viscosity improvers, friction modifiers, pour point depressants, long chain polymers, solvents, dispersants or lubricating fluids, etc., or combinations thereof such as automotive transmission or power steering fluids.

It is an object of the present invention to soften the internal polymeric seals such as gaskets, rings and other components of an enclosed fluid system, thereby reducing undesirable leakage or blowby of a system's internal fluids.

DETAILED DESCRIPTION OF THE INVENTION

An ester is an essential component of the treatment and the conditioner composition described herein. Although esters as a group include polyesters the esters of the invention have a single ester linkage from the reaction of an aliphatic monocarboxylic acid having from 2 to 5 carbon atoms with a monohydroxyl alcohol having from 2 to 17 carbon atoms more desirably from 6 to 13 carbon atoms. A preferred carboxylic acid is acetic acid having 2 carbon atoms. Especially suitable in the present invention are acetate esters that have been synthesized from acetic acid and a branched or linear, aliphatic primary alcohols in the $C_1$ or $C_2$ to $C_{13}$ range. A desired acetate ester compound can be represented by the formula $$C_{R1}H_{R2}OCOCH_3$$

where R1 is an integer from 1 to 13. R2 is equal to 2 times R1, plus 1; or (2×R1)+1. The exact desired value of R1 must be determined with respect to each specific enclosed fluid system, and will vary case by case based on the requirements of the system for lubricity, volatility, and compatibility with polymeric seals. For example, in the treatment of one particular automotive transmission it is preferred that R1 be an integer from 6 to 13. It is further preferred in this particular application that R1 be 13. That is, the ester is a acetate ester of a $C_{13}H_{27}$ alcohol.

The composition is used alone or in combination with one or more plasticizers, diluents, lubricants, viscosity index improvers, solvents, penetrating agents, surfactants, antioxidants, stabilizers, preservatives, friction modifiers, metal protectants, pour point depressant, dispersants, chain polymers, or lubricating fluids or combinations thereof such as hydraulic fluids used as automotive transmission, power steering, or brake fluids.

Examples of plasticizers are phenyl phosphates such as marketed by Monsanto Chemical Co. as Santicizer™ 154, benzyl phthalates such as marketed by Monsanto as Santicizer™ 160, and various benzoid esters made from benzoic acid. A variety of plasticizers are known in the art, and it is not intended to limit the scope of this invention to any particular one.

Examples of diluents, lubricants, and penetrants (penetrating agents) include various paraffinic or naphthenic mineral oils, poly-α-olefin oils, and lubricating base stock oils, as well as automotive transmission, steering, brake or differential fluids. Lubricating base stock oils include petroleum distillate products (including isomerized and hydrocracked oils such as produced by hydrocarbon fractionation), poly(α-olefins) (PAOs), synthetic ester lubricants, etc., or combinations thereof. Example dispersants are alkenyl succinimides, such as acyclic hydrocarbyl substituted succinimides. Examples of surfactants are sufonic acids and their salts, such as dodecylbenzene sulfonic acid or an alkali salt thereof. Examples of viscosity index improvers are polymethacrylate polymers, polyacrylates, styrene-maleic ester copolymers, and similar polymeric substances including homopolymers, copolymers, and graft copolymers. Examples of antioxidants or stabilizers are phenyl alpha naphthylamine, phenyl beta naphthylamine, diphenylamine, bis-alkylated diphenyl amines, sterically hindered phenols, bis-phenols, and the like. Examples of friction modifiers are N-aliphatic hydrocarbyl-substituted diethanolamine, and N-aliphatic hydrocarbyl-substituted trimethylenediamine. Examples of chain polymers that are used to close leaks in transmissions are polyisobutylene and olefinic copolymer. Pour point depressants are chemical compounds that keep a lubricant liquid at low temperatures such as 0° or −10° C. for use in winter. Metal protectants are chemicals that prevent a lubricant from solubilizing, dissolving or corroding metal surfaces.

It is intended that the resulting composition simply be poured into or otherwise inserted into the interior of an enclosed fluid system, either as an additive to the system's existing fluid or as the system's fluid. Alternatively, the composition can be combined with a hydraulic or other fluid obtained from another source prior to the resulting liquid being itself poured into or otherwise inserted into the interior of the system. The composition can also be similarly used in refrigeration or air conditioner systems when combined with the refrigerant.

The seals desirably comprise butyl rubber, butyl-nitrile rubber, chlorosulfonated polyethylene, corked filled elastomers, ENBR, EPDM, EPR, ethylene acetate copolymers, fluorocarbon polymers such as Vikon, hydrin rubbers, hydrogenated nitrile rubber, nitrile rubber, natural rubber, neoprene rubber, polyacrylates, polynorborene, polyurethane, silicone, or styrenebutadiene rubber or combinations thereof. The seals for some applications are cork, buna rubber, paper, steel-rubber or a metal-rubber laminate sponge, fiberglass reinforced composite, or an asbestos or asbestos composite.

Although slight softening of the seals is desirable, the seals are not softened excessively so as to decrease their physical integrity or deform their shape. The invention is better understood by reference to the above examples, as well as following examples which serve to illustrate but not limit the invention.

EXAMPLES

The following table shows various examples have softened sample polymeric seal, ring or gasket materials. Rubbers tested were various automotive transmission seals such as those based on Buna-N a nitrile rubber. This is one of the common seal materials used in automatic transmissions.

TABLE 1

| | | | |
|---|---|---|---|
| 1 | 5% Santicizer ™ 154 | 95% $C_{13}$ Acetate Ester | — |
| 2 | 50% " " | 50% " " | — |
| 3 | 95% " " | 5% " " | — |
| 4 | 5% " 160 | 95% " " | — |
| 5 | 50% " 160 | 50% " " | — |
| 6 | 95% " 160 | 5% " " | — |
| 7 | 5% Santicizer ™ 154 | 90% " " | 5% Santicizer ™ 160 |
| 8 | 25% " " | 50% " " | 25% |
| 9 | 45% " " | 10% " " | 45% |
| 10 | 95% Dextron ™ ATF | 5% " " | — |
| 11 | 95% " " | 2.5% " " | 2.5% |
| 12 | 95% " " | 2.5% " " | 2.5% Santicizer ™ 154 |
| 13 | — | 100% " " | — |
| 14 | — | 100% $C_9$ Acetate Ester | — |
| 15 | — | 100% $C_6$ Acetate Ester | — |
| 16 | 50% Santicizer ™ 160 | 50% $C_9$ Acetate Ester | — |
| 17 | 50% " 154 | 50% $C_6$ Acetate Ester | — |

* $C_{13}$ Acetate Ester is $C_{13}H_{27}OCOCH_3$, $C_9$ acetate ester is $C_9H_{19}OCOCH_3$, and $C_6$ acetate ester is $C_6H_{13}OCOCH_3$. These esters are available from Exxon as Exxate ™ 600–1300.
** Santicizer ™ 154 is a phosphate ester, $C_{22}H_{23}O_4P$ and Santicizer ™ 160 is a phthalate ester, $C_{19}H_{20}O_4$.

A variety of liquids that might function to soften rubber were tested by an outside independent contract laboratory service. The liquids include pinenes, acetate esters, toluene, petroleum distillates, dodecylbenzene sulfonic acid, phosphate esters and mixtures thereof. The acetate esters of $C_{13}$ alcohol had the longest term softening effect (e.g. retained softening effect for 26 days after 2 treatments) of the samples tested. The treatments comprised wiping the liquid on the surface of the rubber with a Q-tip™ cotton swab and allowing the surface to air dry at 23°±2° C. The treatment was repeated once 24 hours later.

Table 2 below shows the surface hardness at various times after the second application. Surface hardness was measured with a Wallace Micro-Indentation Tester according to ASTM D1415-88. Sample 9 was the acetate ester of a monohydric alcohol having 13 carbon atoms. Sample 12 was the same acetate ester diluted 50:50 by volume with toluene. Sample 23 was the same acetate ester as sample 9 diluted 50:50 by volume with Sovenol™ 226 a pinene based liquid. A control received no treatment.

TABLE 2

| Sample ID | Microhardness Decrease from Control | | | | |
|---|---|---|---|---|---|
| After | 24 hrs. | 11 days | 16 days | 21 days | 26 days |
| #9 | −2 | −1 | −1 | −1 | −1 |
| #12 | −3 | −2 | −2 | −3 | −2 |
| #23 | −3 | −2 | −2 | −1 | −1 |

It is to be understood that although the present invention has been specifically disclosed with the preferred embodiment and examples, modifications to the experimental formulation may be apparent to those skilled in the art and such modifications and variations are considered to be within the scope of the invention and the appended claims. It is also intended that all matter contained in the above description shall be interpreted as illustrative and not in a limiting sense, the scope of the invention being indicated by the appended claims rather than by the foregoing description, and all changes that come within the meaning and range of the equivalency of the claims are therefore intended to be embraced therein. That is, the following claims are intended to cover all of the generic and specific features of the invention herein described, and all statements of the scope of the invention which, as a matter of language, fall there between.

What is claimed is:

1. A process for treating an interior seal of an enclosed fluid system, comprising;

adding to the fluid system a composition including one or more esters of an aliphatic monocarboxylic acid having 2 carbon atoms reacted with an aliphatic monohydric alcohol having from 2 to 17 carbon atoms.

2. A process according to claim 1, wherein the enclosed fluid system contains a hydraulic fluid.

3. A process according to claim 2, wherein said enclosed fluid system is an automotive automatic transmission.

4. A process according to claim 2, wherein said enclosed fluid system is an automotive power steering system.

5. A process according to claim 2, wherein the enclosed fluid system is an enclosed fluid lubricated gearbox or differential.

6. A process according to claim 1, wherein said enclosed fluid system is a refrigeration or air conditioning system.

7. A process according to claim 2, wherein said ester has the formula $$C_{R1}H_{R2}OCOCH_3$$

where R1 is an integer from 2 to 13; and R2 is equal to (2×R1)+1.

8. A process according to claim 7, wherein said R1 is from 6 to 13.

9. A process according to claim 8, wherein said composition further includes one or more of the following: plasticizers, lubricants, friction modifiers, antiwear additives, viscosity index improvers, pour point depressants, antioxidants, metal protectants, dispersants, solvents, surfactants, diluents, stabilizers, penetrating agents, chain polymers and hydraulic fluids.

10. A composition for conditioning the seals and/or gaskets of an enclosed fluid system, the composition comprising;

one or more esters of an aliphatic carboxylic acid having 2 carbon atoms reacted with an aliphatic monohydric alcohol having from 2 to 17 carbon atoms, one or more plasticizers and one or more hydraulic fluids.

11. A composition according to claim 10, wherein said one or more esters comprises an acetate ester of acetic acid and a monohydric alcohol having from 6 to 13 carbon atoms.

12. A composition according to claim 11, wherein said plasticizers are one or more phosphate esters.

13. A composition according to claim 11, wherein said plasticizers are one or more phthalate esters.

14. A composition according to claim 11, wherein said plasticizers are one or more benzoid esters.

15. A composition for conditioning the seals and/or gaskets of an enclosed fluid system, the composition comprising;

one or more esters of an aliphatic carboxylic acid having 2 carbon atoms reacted with an aliphatic monohydric alcohol having from 2 to 17 carbon atoms, and one or more of the following: plasticizers, friction modifiers, antiwear additives, viscosity index improvers, pour point depressants, metal protectants, chain polymers and hydraulic fluids.

16. A composition for conditioning the seals and/or gaskets of an enclosed fluid system, the composition comprising;

one or more esters of acetic acid reacted with an aliphatic monohydric alcohol having from 2 to 17 carbon atoms, and one or more hydraulic fluids.

17. A composition according to claim 16, wherein the hydraulic fluid is automotive transmission fluid.

18. A composition according to claim 16, where the hydraulic fluid is automotive power steering fluid.

19. A composition according to claim 16, wherein the hydraulic fluid is automotive brake fluid.

20. A composition according to claim 16, where the hydraulic fluid is tractor hydraulic fluid.

* * * * *